US011408271B2

(12) United States Patent
Sengul et al.

(10) Patent No.: US 11,408,271 B2
(45) Date of Patent: Aug. 9, 2022

(54) WELL PUMP DIAGNOSTICS USING MULTI-PHYSICS SENSOR DATA

(71) Applicant: Noven, Inc., Houston, TX (US)

(72) Inventors: Mahmut Sengul, Houston, TX (US); Mario Ruscev, Houston, TX (US); Karim Boudah, Houston, TX (US); Juan Felipe Arjona, Houston, TX (US)

(73) Assignee: NOVEN, INC., Houston, TX (US)

( * ) Notice: Subject to any disclaimer, the term of this patent is extended or adjusted under 35 U.S.C. 154(b) by 114 days.

(21) Appl. No.: 16/898,639

(22) Filed: Jun. 11, 2020

(65) Prior Publication Data

US 2020/0392834 A1 Dec. 17, 2020

Related U.S. Application Data

(60) Provisional application No. 62/859,979, filed on Jun. 11, 2019, provisional application No. 62/860,038, filed on Jun. 11, 2019.

(51) Int. Cl.

| | |
|---|---|
| ***E21B 47/009*** | (2012.01) |
| ***E21B 47/06*** | (2012.01) |
| ***E21B 47/007*** | (2012.01) |
| ***E21B 47/18*** | (2012.01) |

(52) U.S. Cl.

CPC ..... *E21B 47/009* (2020.05); *E21B 47/007* (2020.05); *E21B 47/06* (2013.01); *E21B 47/18* (2013.01)

(58) Field of Classification Search

CPC ..... E21B 47/009; E21B 47/007; E21B 47/06; E21B 47/12; E21B 47/18

See application file for complete search history.

(56) References Cited

U.S. PATENT DOCUMENTS

| | | | | |
|---|---|---|---|---|
| 3,343,409 | A | 10/1966 | Gibbs | |
| 3,464,276 | A | 9/1969 | Leibert | |
| 3,635,081 | A | 1/1972 | Gibbs | |
| 3,951,209 | A | 4/1976 | Gibbs | |
| 4,490,094 | A | 12/1984 | Gibbs | |
| 4,509,901 | A | 4/1985 | McTamaney et al. | |
| 4,932,253 | A | 6/1990 | McCoy | |
| 4,989,671 | A * | 2/1991 | Lamp | E21B 43/121 137/624.2 |
| 5,167,490 | A | 12/1992 | McKee et al. | |
| 5,252,031 | A | 10/1993 | Gibbs | |
| 5,464,058 | A | 11/1995 | McCoy et al. | |
| 5,941,305 | A | 8/1999 | Thrasher et al. | |
| 6,176,682 | B1 | 1/2001 | Mills | |

(Continued)

FOREIGN PATENT DOCUMENTS

| | | | |
|---|---|---|---|
| AU | 2004316883 | B2 | 9/2005 |
| EP | 3118409 | B1 | 7/2016 |
| WO | 2009/005876 | A2 | 1/2009 |

*Primary Examiner* — Franklin D Balseca

(74) *Attorney, Agent, or Firm* — MH2 Technology Law Group LLP

(57) ABSTRACT

A method includes receiving acoustic signals from one or more acoustic sensors that are coupled to a beam pump unit. The method also includes identifying a frequency of the beam pump unit in the acoustic signals. The method also includes detecting an outlier in the acoustic signals based at least partially upon the identified frequency. The outlier represents an operational issue with the beam pump unit.

15 Claims, 14 Drawing Sheets

(56) References Cited

U.S. PATENT DOCUMENTS

| | | | | |
|---|---|---|---|---|
| 6,553,131 | B1 | 4/2003 | Neubauer et al. | |
| 6,763,148 | B1 | 7/2004 | Sternberg et al. | |
| 7,212,923 | B2 | 5/2007 | Gibbs et al. | |
| 7,634,328 | B2 | 12/2009 | Medizade et al. | |
| 8,157,537 | B2 | 4/2012 | Chavez Zapata | |
| 8,444,393 | B2 | 5/2013 | Beck et al. | |
| 8,984,113 | B2 | 5/2015 | Li et al. | |
| 9,080,438 | B1 | 7/2015 | McCoy et al. | |
| 9,506,751 | B2 | 11/2016 | Zhao | |
| 9,983,076 | B2 | 5/2018 | Zhao | |
| 10,794,173 | B2 * | 10/2020 | Ebrahimi | E21B 41/00 |
| 10,926,527 | B2 * | 2/2021 | Gifford | B33Y 30/00 |
| 2008/0143512 | A1 | 6/2008 | Wakisaka et al. | |
| 2008/0240930 | A1 | 10/2008 | Palka et al. | |
| 2012/0020445 | A1 | 1/2012 | Distasi et al. | |
| 2012/0020808 | A1 | 1/2012 | Lawson et al. | |
| 2013/0030721 | A1 | 1/2013 | Palka et al. | |
| 2013/0127390 | A1 | 5/2013 | Dacunha et al. | |
| 2013/0151216 | A1 | 6/2013 | Palka et al. | |
| 2013/0277063 | A1 | 10/2013 | Palka | |
| 2013/0333880 | A1 | 12/2013 | Raglin et al. | |
| 2015/0176395 | A1 | 6/2015 | McCoy | |
| 2015/0308257 | A1 | 10/2015 | McCoy et al. | |
| 2015/0345280 | A1 | 12/2015 | Krauss | |
| 2015/0377006 | A1 | 12/2015 | Pons | |
| 2017/0030348 | A1 | 2/2017 | Mills | |
| 2017/0159422 | A1 | 6/2017 | McCoy | |
| 2017/0167482 | A1 | 6/2017 | Assad et al. | |
| 2017/0306745 | A1 | 10/2017 | Harding et al. | |
| 2020/0263531 | A1 * | 8/2020 | Fyfe | F04B 47/026 |

* cited by examiner

WELL PUMP DIAGNOSTICS USING MULTI-PHYSICS SENSOR DATA

CROSS-REFERENCE TO RELATED APPLICATIONS

This application claims priority to U.S. Patent Application No. 62/859,979, filed on Jun. 11, 2019. This application also claims priority to U.S. Patent Application No. 62/860,038, filed on Jun. 11, 2019. The entirety of both applications is incorporated by reference herein.

BACKGROUND

Beam pumps are used to provide artificial lift in wells, allowing producing of hydrocarbons from the wells. The method is popular because of its simplicity, reliability, and applicability to a wide range of operating conditions. However, beam pumps are prone to inefficiency from a variety of issues that can be difficult to diagnose. Well shutdowns caused by delayed equipment diagnostics may result in lost production and health, safety, and environmental (HSE) issues. The ability to identify beam pumping operating conditions may thus enhance oil well profitability over the long-term.

SUMMARY

A method for diagnosing an operational issue with a beam pump unit is disclosed. The method includes receiving acoustic signals from one or more acoustic sensors that are coupled to a beam pump unit. The method also includes identifying a frequency of the beam pump unit in the acoustic signals. The method also includes detecting an outlier in the acoustic signals based at least partially upon the identified frequency. The outlier represents an operational issue with the beam pump unit.

In another embodiment, the method includes receiving analog acoustic data from one or more acoustic sensors that are coupled to a beam pump unit. The method also includes receiving analog strain data from a strain gauge that is coupled to a polished rod of the beam pump unit. The method also includes receiving analog gyroscopic data from a gyroscope that is coupled to the polished rod. The method also includes receiving analog acceleration data from an accelerometer that is coupled to the polished rod. The method also includes converting the analog acoustic data, the analog strain data, the analog gyroscopic data, and the analog acceleration data to digital data using one or more analog-to-digital converters. The method also includes transmitting the digital data to an external computing system using a transceiver. The digital data is used to detect an operational issue with the beam pump unit.

A system for diagnosing an operational issue with a beam pump unit is also disclosed. The system includes a first acoustic sensor coupled to a polished rod of a beam pump unit and configured to measure first analog acoustic data. The system also includes a second acoustic sensor coupled to a gearbox of the beam pump unit and configured to measure second analog acoustic data. The system also includes a third acoustic sensor coupled to a prime mover of the beam pump unit and configured to measure third analog acoustic data. The system also includes an enclosure coupled to the beam pump unit. The system also includes one or more analog-to-digital converters positioned at least partially within the enclosure and configured to convert the first analog acoustic data, the second analog acoustic data, and the third analog acoustic data into digital data. The system also includes a transceiver positioned at least partially within the enclosure and configured to transmit the digital data to an external computing system.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
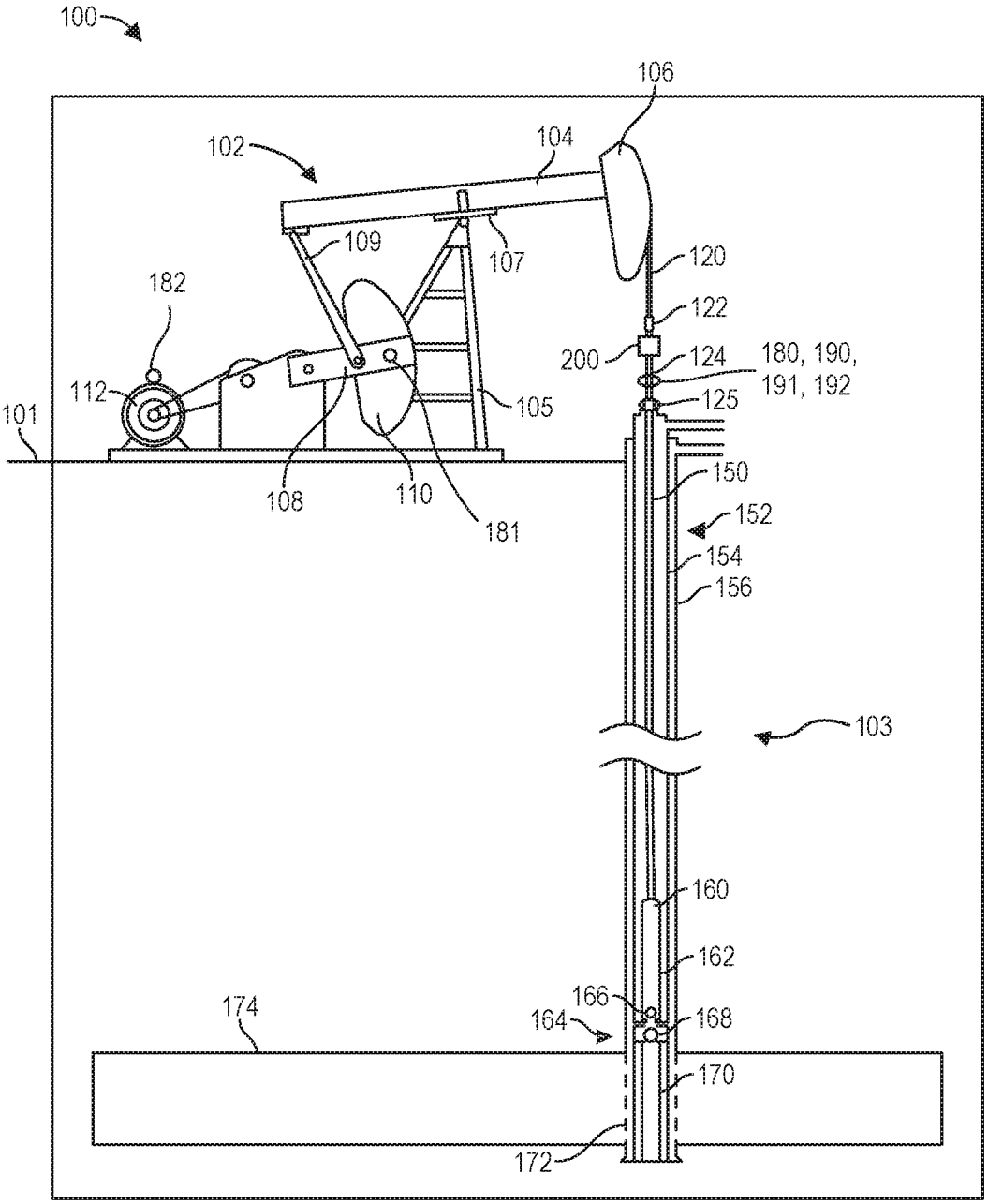
FIG. 1 illustrates a schematic view of a beam pump unit, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Well Pump Diagnostics Using Acoustic Data Sensor

Beam pump units are a coupled system including a prime mover that transfers rotational movement to a gearbox. The gearbox may vary (e.g., reduce) a number of cycles based on a gear ratio in the gearbox. The rotational movement is converted into linear axial movement by pitman arms, a walking beam, and a rod string that includes a polished rod. The cycle time at each stage/segment is different. In an example, the motor speed may be 3600 cycles per minute, the gear box and/or crank shaft speed may be 100 cycles per minute, and the polished rod speed may be 10 cycles per minute.

Embodiments of the present disclosure may isolate and determine the sound intensity (e.g., frequency and/or amplitude) at the various stages/segments. The sound intensity may provide insight into the operating conditions of the beam pump unit. Embodiments of the disclosure may include attaching an acoustic sensor (e.g., including a microelectromechanical (MEM) microphone) close to the pump unit (e.g., on the walking beam) and recording and analyzing the audio spectrum to detect possible outlier (e.g., anomaly) signals that may indicate a problem. In some embodiments, a machine learning (ML) algorithm may detect and diagnose the source of the anomaly. Such sources may include motor problems, gearbox problems, crank problems, polished rod bending, subsurface pump pounding, tagging, hitting hard, and bearing problems.

FIG. 1 illustrates a schematic view of a beam pump unit 100, according to an embodiment. The beam pump unit 100 may include a surface system 102 and a downhole system 103. The surface system 102 may include a walking beam 104 having a horsehead 106 connected at a distal end thereto. The walking beam 104 may be supported from the ground 101 by a samson post 105 connected to the walking beam 104 via a center bearing 107. At a proximal end of the walking beam 104, a pitman arm 109 may connect the walking beam 104 to a crank arm (also referred to as a gearbox crankshaft) 108. The crank arm 108 may include a counterbalance weight 110, and may be driven by a prime mover 112, such as an internal-combustion engine or motor. The prime mover 112 causes the crank arm 108 to move through an arc, generally up and down with respect to the ground 101. In turn, this drives the walking beam 104 to pivot about the center bearing 107, causing the horsehead 106 to move through an arc, generally up-and-down with respect to the ground 101.

A bridle 120 may be coupled to the horsehead 106, and may be connected via a carrier bar 122 to a polished rod 124. The polished rod 124 may connect the surface system 102 with the downhole system 103. A stuffing box 125 (and/or other components of a wellhead) may prevent egress of fluids, gasses, etc. from the downhole system 103 along the polished rod 124. The downhole system 103 may include sucker rods 150 that extend down through a wellbore 152, e.g., through production tubing 154 and a casing 156 disposed in the wellbore 152. A plunger 160 may be connected to a lower end of the sucker rods 150. The plunger 160 may fit into a pump barrel 162, and a valve system 164 (e.g., a travelling valve 166 and a standing valve 168) may be positioned at or near to the lower end of the sucker rods 150. A gas anchor 170 may be positioned at the bottom of the wellbore 152, e.g., near perforations 172 formed therein, which may provide a communication path for fluids, e.g., hydrocarbons, in a subterranean reservoir 174. Accordingly, as the surface system 102 operates to move the horsehead 106 up and down, this movement is transmitted via the bridle 120, carrier bar 122, and polished rod 124 to the sucker rods 150. In turn, the sucker rods 150 apply pressure into the wellbore 152, which tends to draw fluid upward in the production tubing 154, enabling production of fluid, e.g., hydrocarbons, from the perforations 172 to the surface.

One or more sensors (three are shown: 180, 181, 182) may be coupled to the beam pump unit 100. The sensors 180-182 may be or include acoustic sensors. For example, the sensors 180-182 may be or include microelectromechanical systems (MEMS) that rely on the modulation of surface acoustic waves generated by operation of the beam pump unit 100 to sense a physical phenomenon. The sensors 180-182 may transduce an input electrical signal into a mechanical wave which, unlike an electrical signal, can be easily influenced by physical phenomena of the beam pump unit 100. The sensors 180-182 then transduce this wave back into an output electrical signal. Changes in amplitude, phase, frequency, and/or time-delay between the input and output electrical signals can be used to measure the presence of the desired phenomenon. The signals may be or include amplitude signals or amplitude vs time signals.

As mentioned above, the sensors 180-182 may be attached to the beam pump unit 100. In an embodiment, one or more of the sensors 180-182 may be coupled to the surface unit 102. For example, one or more of the sensors 180-182 may be coupled to the walking beam 104, the samson post 105, the horsehead 106, the center bearing 107, the crank arm 108, the pitman arm 109, the prime mover 112, the bridle 120, the carrier bar 122, the polished rod 124, the stuffing box 125, or a combination thereof. As shown, the first sensor 180 is coupled to the polished rod 124, the second sensor 181 is coupled to the crank arm 108, and the third sensor 182 is coupled to the prime mover 112.

In another embodiment, one or more of the sensors 180-182 (or additional acoustic sensors) may be coupled to the downhole unit 103. For example, the sensors 180-182 may be coupled to the sucker rod 150, the production tubing 154, the casing 156, the plunger 160, the pump barrel 162, the valve system 164, the travelling valve 166, the standing valve 168, the gas anchor 170, or a combination thereof.

In at least one embodiment, one or more (e.g., non-acoustic) sensors (three are shown: 190, 191, 192) may also be coupled to the beam pump unit 100. For example, a strain gauge 190, a gyroscope 191, and an accelerometer 192 may be coupled to one or more moving components of the beam pump unit 100. For example, the strain gauge 190, gyroscope 191, and accelerometer 192 may each be coupled to the polished rod 124.

Figure 2:
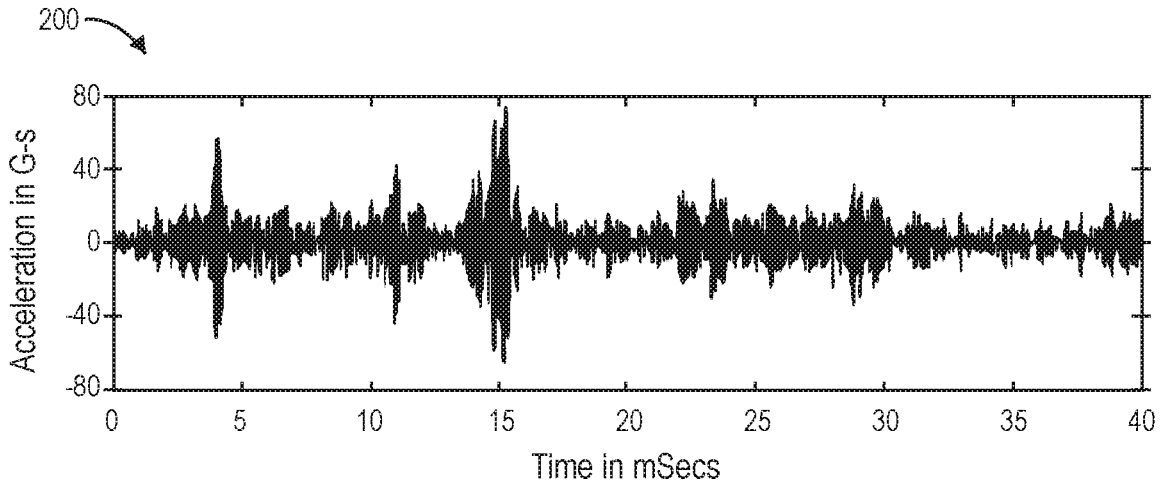
FIG. 2 illustrates a graph showing raw data collected by one or more sensors on the beam pump unit, according to an embodiment.

FIG. 2 illustrates a graph 200 showing raw data collected by one or more of the sensors 180-182, according to an embodiment. The raw data represents acceleration versus time. In another embodiment, the raw data may represent amplitude versus time.

Figure 3A:
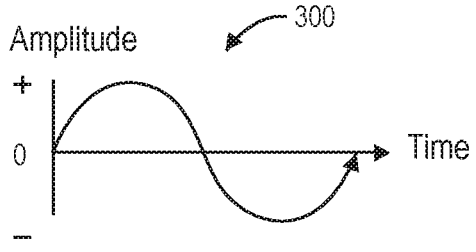
FIG. 3A illustrates a graph of amplitude versus time of a soundwave captured by the first sensor, which is coupled to a polished rod of the beam pump unit, according to an embodiment.
Figure 3B:
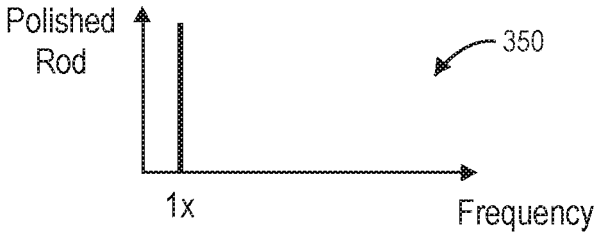
FIG. 3B illustrates a graph of a frequency of the signal in FIG. 3A, represented as a single line, according to an embodiment.

FIG. 3A illustrates a graph 300 of amplitude versus time of a soundwave captured by the first sensor 180, which is coupled to the polished rod 124, according to an embodiment. FIG. 3B illustrates a graph 350 of a frequency of the signal in FIG. 3A, represented as a single line, according to an embodiment.

Figure 4A:
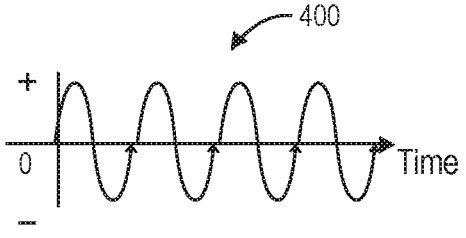
FIG. 4A illustrates a graph of amplitude versus time of a soundwave captured by the second sensor, which is coupled to a crank arm of the beam pump unit, according to an embodiment.
Figure 4B:
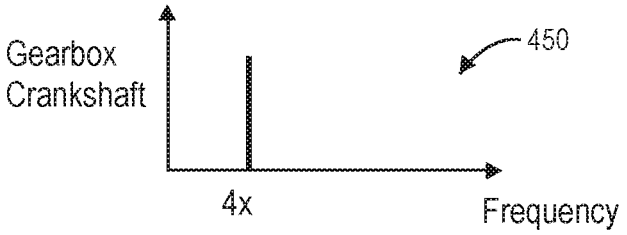
FIG. 4B illustrates a graph of a frequency of the signal in FIG. 4A, represented as a single line, according to an embodiment.

FIG. 4A illustrates a graph 400 of amplitude versus time of a soundwave captured by the second sensor 181, which is coupled to the crank arm 108, according to an embodiment. FIG. 4B illustrates a graph 450 of a frequency of the signal in FIG. 4A, represented as a single line, according to an embodiment. As may be seen, the frequency of the signal in FIG. 4B is 4× the frequency of the signal in FIG. 3B.

Figure 5A:
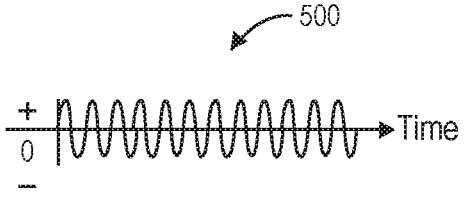
FIG. 5A illustrates a graph of amplitude versus time of a soundwave captured by the third sensor, which is coupled to a prime mover of the beam pump unit, according to an embodiment.
Figure 5B:
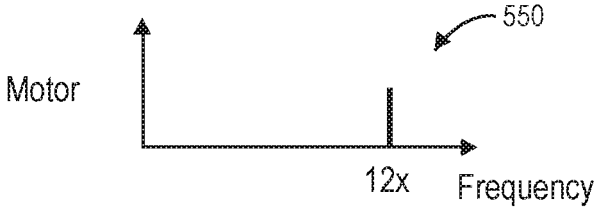
FIG. 5B illustrates a graph of a frequency of the signal in FIG. 5A, represented as a single line, according to an embodiment.

FIG. 5A illustrates a graph 500 of amplitude versus time of a soundwave captured by the third sensor 182, which is coupled to the prime mover 112, according to an embodiment. FIG. 5B illustrates a graph 550 of a frequency of the signal in FIG. 5A, represented as a single line, according to an embodiment. As may be seen, the frequency of the signal in FIG. 5B is 12× the frequency of the signal in FIG. 3B.

There may be a range of frequencies for noise generated at each of these sources (e.g., polished rod 124, crank arm 108, prime mover 112), but it may be centered at a characteristic frequency such as that shown. Moreover, as depicted, the characteristic frequency of the polished rod 124 may be lower than that of the crank arm 108, which is lower than that of the prime mover 112. As such, anomalous noises near the characteristic frequency of one of the polished rod 124, crank arm 108, or prime mover 112 may have a source that is related to that component. The ML algorithm may take that at least as a starting point for identifying a specific running condition/problem based on the anomalous noise.

Figure 6:
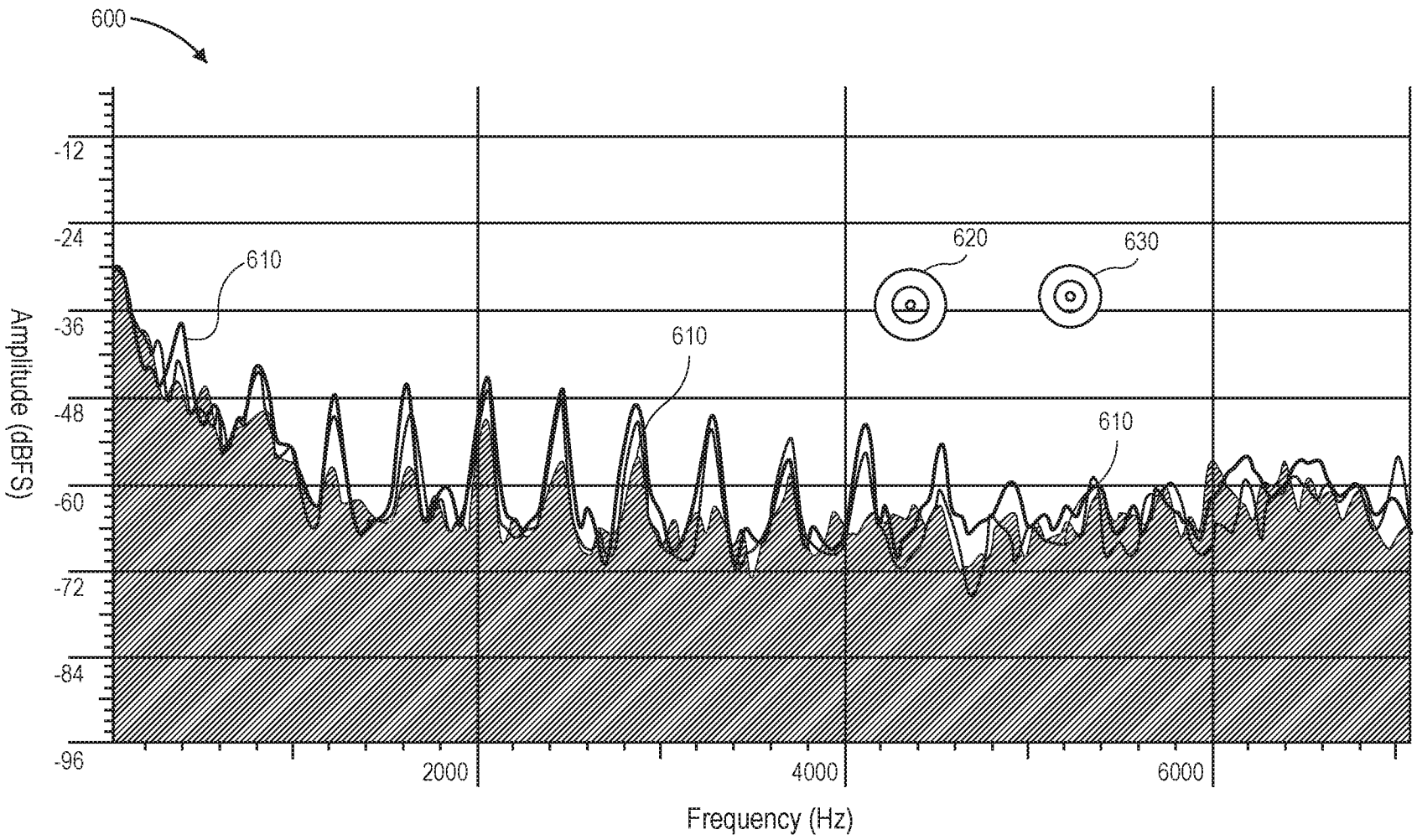
FIG. 6 illustrates a graph of the acoustic data in the frequency domain, according to an embodiment.

FIG. 6 illustrates a graph 600 of acoustic data in the frequency domain, according to an embodiment. The graph 600 shows acoustic signals 610 from a portion of the beam pump unit 100. The acoustic signals 610 may be measured by the sensors 180-182. The graph 600 also shows two outliers (e.g., noise sources) 610, 620 in/from the acoustic signals 610. The first outlier 610 occurs at about 4500 Hz and about −35 dBFS. The second outlier 620 occurs at about 5200 Hz and about −34 dBFS. The ML algorithm may identify these outliers 610, 620, determine their frequencies, and predict an operational issue that causes them. For example, the outliers 610, 620 may occur at frequencies closest to the prime mover 112, and thus the operational issue may be due to (or closer to) the prime mover 112 than, for example, the gearbox 108 and/or the polished rod 124, which operate at lower frequencies.

Figure 7:
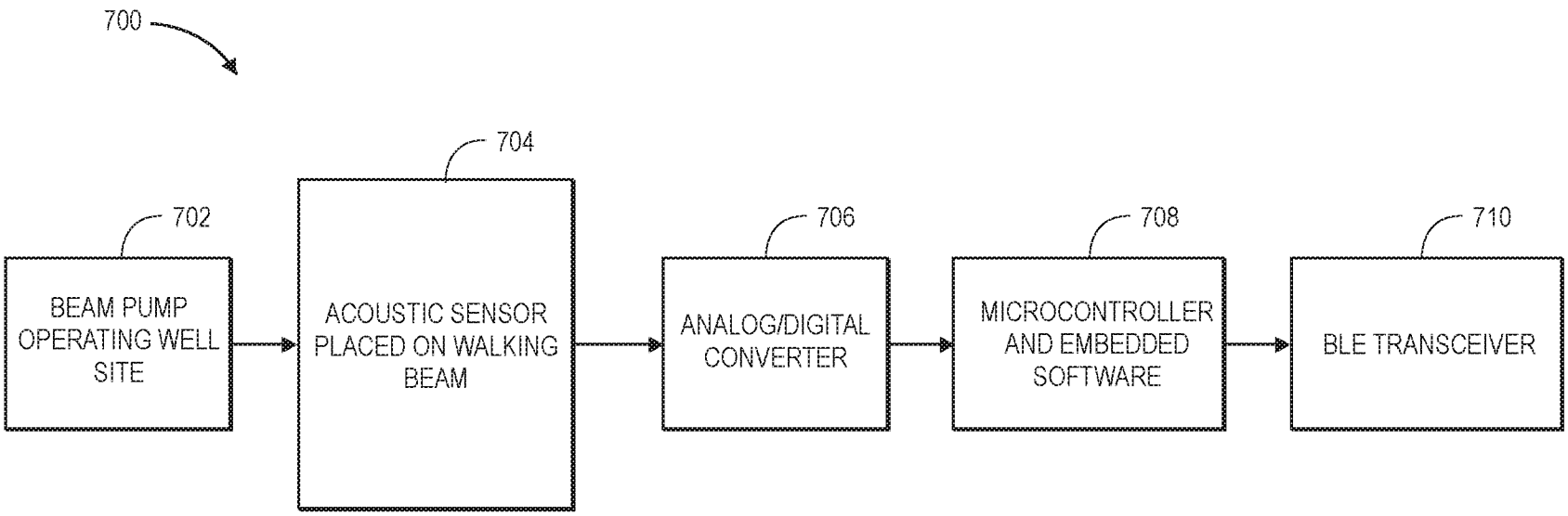
FIG. 7 illustrates a functional block diagram of a system that employs acoustic analysis to detect and diagnose running conditions in the beam pump unit, according to an embodiment.

FIG. 7 illustrates a functional block diagram of a system 700 that employs acoustic analysis to detect and diagnose running conditions in the beam pump unit 100, according to an embodiment. As shown, the beam pump unit 100 is operated at the well site, as at 702. The sensors 180-182 are coupled to the beam pump unit 100 and configured to measure the acoustic signals, as at 704. The acoustic signals may be analog. An analog-to-digital converter (ADC) receives the analog signals and converts the signals into digital acoustic signals, as at 706. A microcontroller and embedded software then receives and processes the digital signals, as at 708. The signals are then transmitted to an external computing system using a BLUETOOTH® low energy (BLE) transceiver, as at 710. In at least one embodiment, the ADC, the microcontroller, and the transceiver may be positioned within an enclosure that is coupled to one or more of the sensors 180-182 and/or to the beam pump unit 100.

Figure 8:
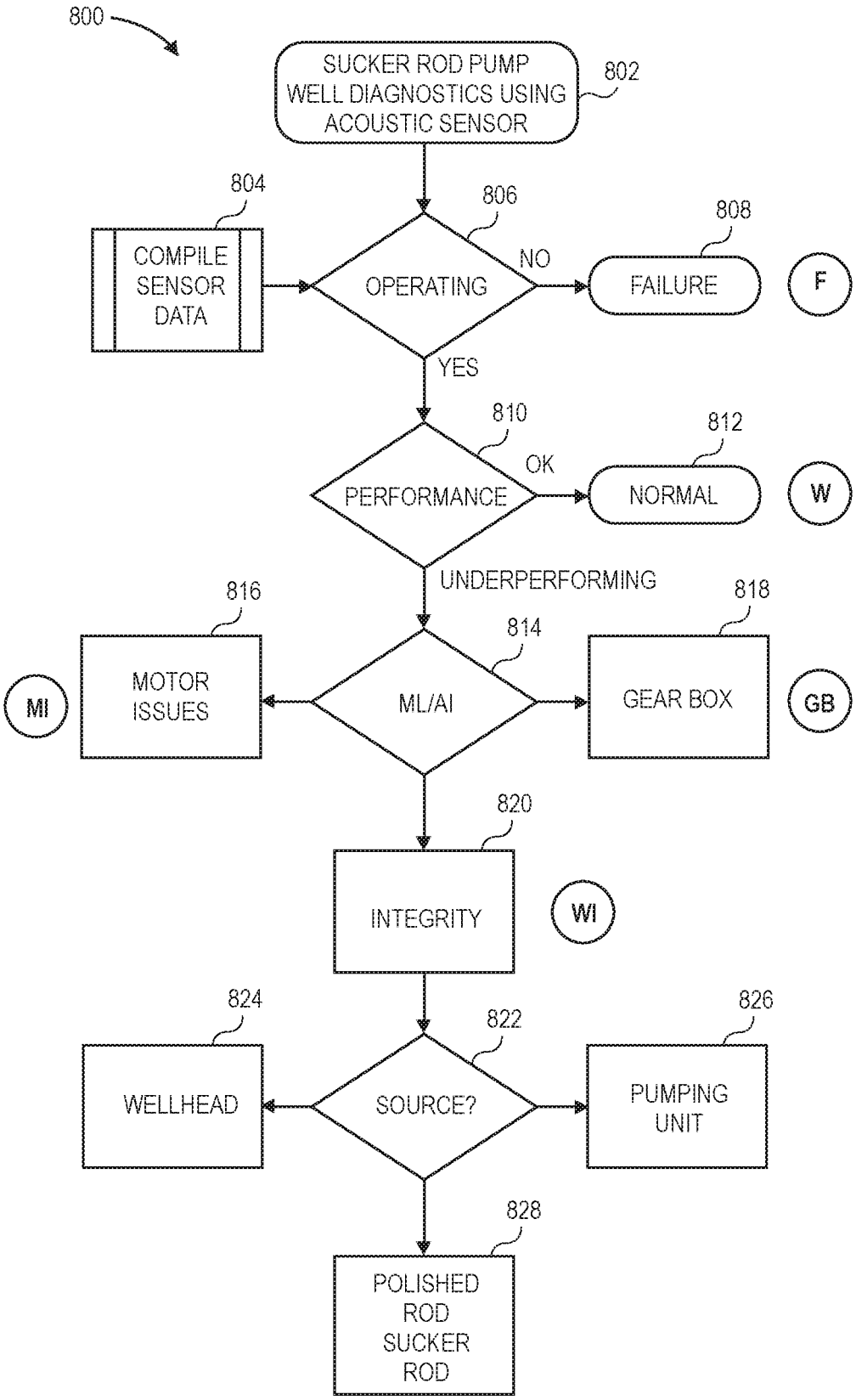
FIG. 8 illustrates a flowchart of a method for diagnosing the beam pump unit using the sensors, according to an embodiment.

FIG. 8 illustrates a flowchart of a method 800 for diagnosing the beam pump unit 100 using the sensors 180-182, 190-192, according to an embodiment. The method 800 may include receiving sucker rod pump well diagnostics, as at 802. The sucker rod pump well diagnostics may be based at least partially upon the acoustic measurements from the sensor(s) 180-182. The method 800 may also include receiving and/or compiling the measurements from other sensors, such as the strain gauge 190, the gyroscope 191, and the accelerometer 192, or a combination thereof, as at 804.

The method 800 may also include determining whether the beam pump unit 100 is operating, as at 806. This determination may be based at least partially upon the data received at 802, 804, or both. If the beam pump unit 100 is not operating, it may be determined that the beam pump unit 100 is failing, as at 808. If the beam pump unit 100 is operating, then the method 800 may include determining whether the beam pump unit 800 is operating at or above a predetermined level, as at 810. If the performance is at or above the predetermined level, then it may be determined that the beam pump unit 100 is operating normally, as at 812. If the performance is below the predetermined level, the method 800 may include determining a cause for the under-performance, as at 814. The cause may be or include issues with the motor 112 (as at 816), issues with the gearbox 108 (as at 818), the well integrity (as at 820), or a combination thereof. If the cause is inadequate well integrity, then the method 800 may include determining a source of the inadequate well integrity, as at 822. The source may be or include the wellhead (as at 824) or the pumping unit (as at 826). The source may also be or include the polished rod 124, the sucker rod 150, the tubing 154, the casing 156, or a combination thereof, as at 828.

Automated Surveillance System and Method for Wells with Artificial Lift

The present disclosure is directed to an intelligent well site automation controller for beam pump operated oil and gas wells. The architecture of the system utilizes Internet of Things (IoT) and edge computing. To perform edge computing at any well-site, self-sufficient sensors and a gateway (GW) may be used. The gateway may utilize available communication methods ranging from local Ethernet to satellite communication. Power consumption of the gateway under a full load may be minimal, such that the system can be powered from a battery, when no power is available at the well-site.

As described in greater detail below, the system may include one or more sensors, which may include pressure sensors, load sensors, and/or position sensors. The sensors may use BLUETOOTH® Low Energy (BLE) communication, data acquisition, ARM-based CPU, LTE communication, and a power supply. In one embodiment, sensor data and/or the operating system may be Linux-based. The data sources may be or include time-series wellhead casing pressure, tubing pressure, position, displacement, and/or load. Surface dynamometer card computation and automated diagnostics may be performed using Machine Learning (ML). Artificial intelligence (AI) algorithms may be used at the well site. Tank level sensors and gas flow sensors may be incorporated in the system. Daily operating parameters, key performance indicators (KPIs), volumes, and time series visualizations may be accessible via mobile devices and/or a back-office cloud system.

The systems and methods disclosed herein may provide an end-to-end automated smart surveillance system for oil and gas wells installed with a sucker rod pumping unit to increase run time, increase hydrocarbon production, reduce operating cost, and minimize unplanned downtimes. The system may also include real-time or near-real-time data delivery to remote (e.g., external or mobile) devices to provide live KPI reporting. The system may also include data integration at a field level to generate local tasks at the gateway using ML and/or AI algorithms. The system may also include distributed network computing, decision making, and autonomous diagnostics via expert systems. The system may also include automated pump health status diagnostics using ML algorithms. The system may also include control feedback for remotely operated tools. The system may also include an interface with a corporate cloud portal for business systems and advanced analytics (e.g., live MIS and/or KPI reporting). The system may also deliver results (e.g., daily operating reports) to users via mobile devices, laptop computers, and/or desktop computers.

The systems and methods may create an end-to-end ecosystem to perform continuous monitoring, data processing, and automated diagnostic analysis at a well site. The system receives initial data directly from the sensors at an edge computer at a wellsite and applies data driven analytics to determine pump health conditions. For example, the system can capture data, analyze the data, learn from the data, and predict a trend at various levels of the sucker rod pumping process. To accomplish this, the system may have the following capabilities: battery-operated wireless BLE sensors, a battery-operated gateway, embedded software for the sensors and gateway, diagnostic software using ML and AI algorithms, secure cloud computing, role-based applications for the installer, pumper, and engineer, secure web access, secure mobile access, and database and back office services.

The system may receive data from a variety of sensors in a synchronous fashion. Using this data in combination with previously acquired knowledge, the system may assess whether the pumping process is healthy. If an abnormality occurs, the system may isolate the problem (e.g., an electrical fault) and determine the cause of the problem. The system may take appropriate corrective actions to either rectify or contain the problem and continue to monitor without disturbing the pumping process.

Preliminary pump diagnostic options may include: Working (W), working with gas interference (WI), working with pump issues (WP), working with integrity problem (WI), and Failure (F).

Figure 9:
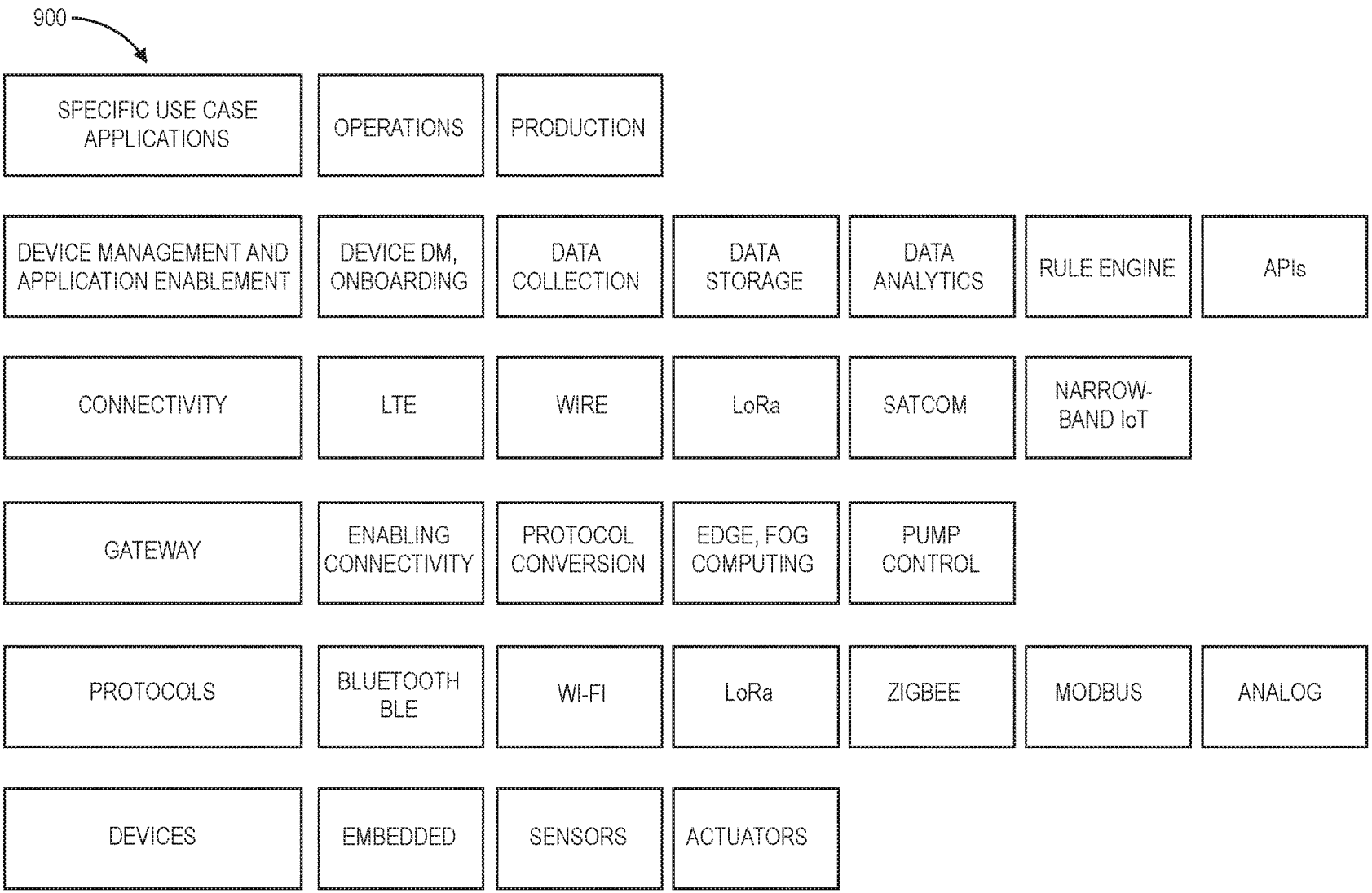
FIG. 9 illustrates a schematic view of a system for monitoring a well, according to an embodiment.

FIG. 9 illustrates a schematic view of a system 900 for monitoring a well (e.g., wellbore 152), according to an embodiment. The system 900 may be or include an IOT that provides an end-to-end solution for oil and gas wells operated by the beam pump unit 100. The system 900 includes: wireless (BLE) pressure sensors, load sensors, and position sensors. The edge gateway at the wellsite may perform local analytics, generate daily reports, and diagnose well health conditions using a ML algorithm. The edge gateway may also connect to a cloud computing system via satellite and LTE communication technology and deliver role-based information to users (e.g., stakeholders) via, for example, iOS and windows-based devices. The sensors and devices may be powered by long-life batteries. The system 900 may be deployed in less than 30 minutes with minimum interruption to operations.

The system 900 has a small footprint and production optimization tools at the well site. The system 900 may differ from conventional systems due to its sensors, processing signals, and data and auto diagnostics at the well site, among other features. The digital transformation from data to production optimization may be achieved through the combination of data-driven analytics, modeling, and diagnostic tools. This may yield an improved level of operational efficiency. Thus, seamless integration at an enterprise level through cloud analytics may provide a digital twin concept. This may empower operating companies to improve real-time operation decision-making and production optimization, as well as maximize ROCI.

Figure 10:
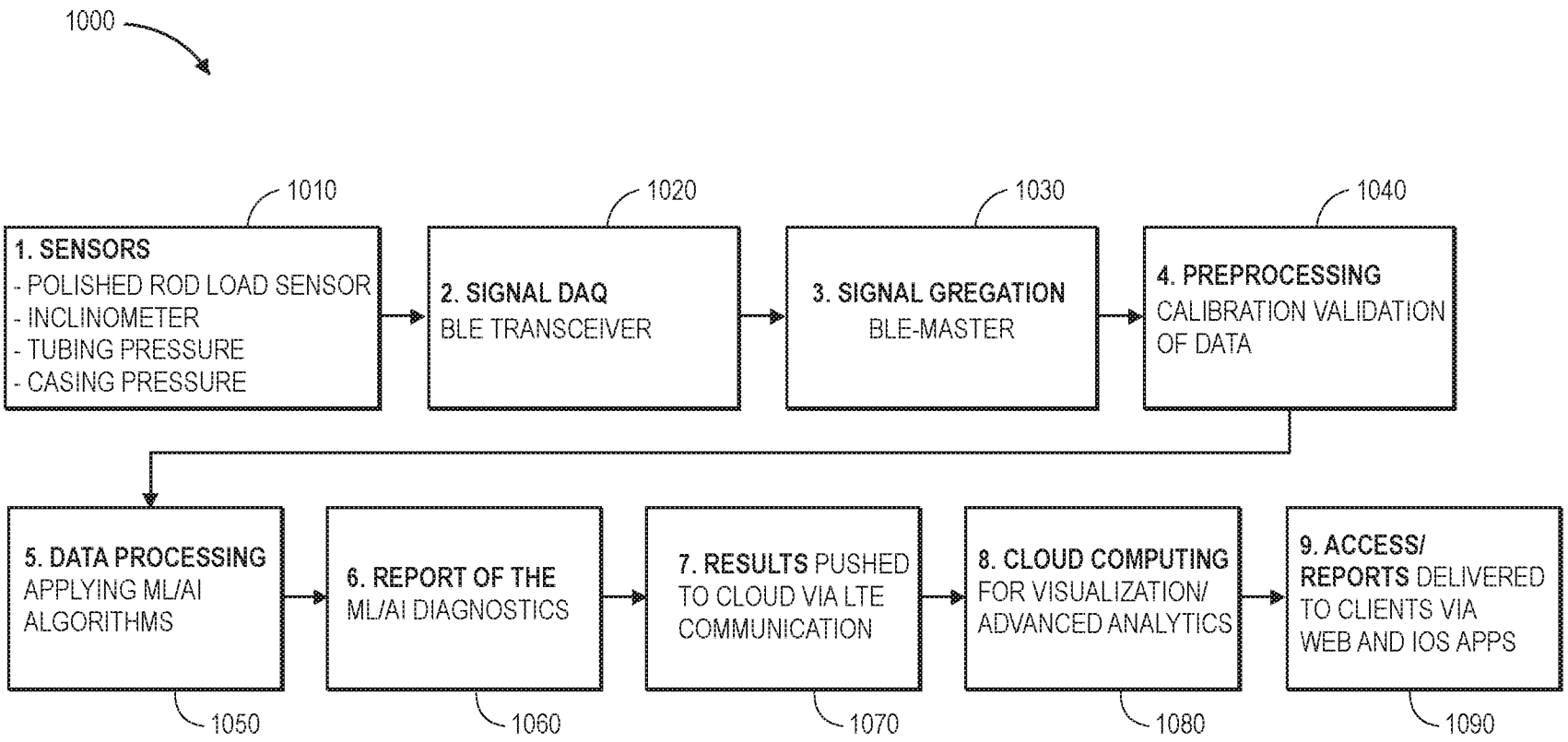
FIG. 10 illustrates a method for monitoring the well, according to an embodiment.

FIG. 10 illustrates a method 1000 for monitoring the well 152, according to an embodiment. The method 1000 may include receiving measured data from one or more sensors, as at 1010. The sensors may be or include a load sensor on the polished rod 124, an inclinometer (e.g., on the walking beam 104 or horsehead 106), a tubing pressure sensor (e.g., on the tubing 154), and a casing pressure sensor (e.g., on the casing 156). The method 1000 may also include receiving and/or transmitting data signals from the sensors, as at 1020. The method 1000 may also include aggregating the data signals, 1030. The method 1000 may also include pre-processing the aggregated signals, as at 1040. The pre-processing may be or include calibrating and/or validating the data. The method 1000 may also include applying ML/AI algorithms to the pre-processed data, as at 1050. The method 1000 may also include reporting the results of the ML/AI algorithms, as at 1060. The method 1000 may also include pushing the results to the cloud, as at 1070. The method 1000 may also include visualizing analytics based upon the results, as at 1080. The method 1000 may also include delivering reports to clients based upon the results and/or the analytics, as at 1090.

Figure 11:
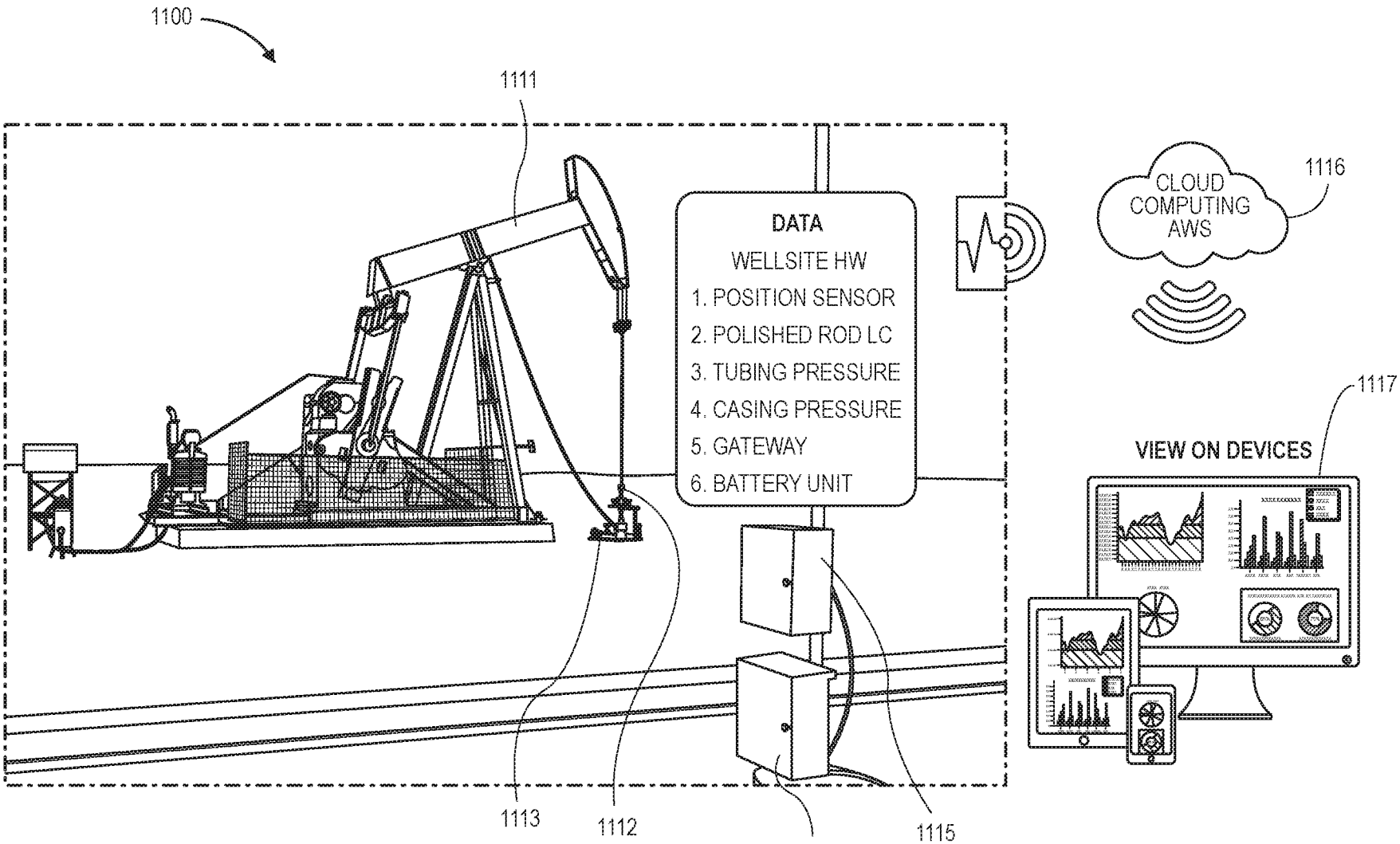
FIG. 11 illustrates a schematic view of another system for monitoring the well, according to an embodiment.

FIG. 11 illustrates a schematic view of a portion of a system 1100 for monitoring the well 152, according to an embodiment. The system 1100 may include a position sensor 1111 coupled to the polished rod 124. The system 1100 may also include a tubing pressure sensor 1112 that is coupled to and/or in communication with the tubing 154, and a casing pressure sensor 1113 that is coupled to and/or in communication with the casing 156. The system 1100 may also include a gateway 1114 and a battery unit 1115. The system 1100 may also include a cloud computing system 1116 and one or more devices 1117 that are configured to receive the data from the sensors 1111, 1112, 1113 via the cloud computing system 1116.

Figure 12:
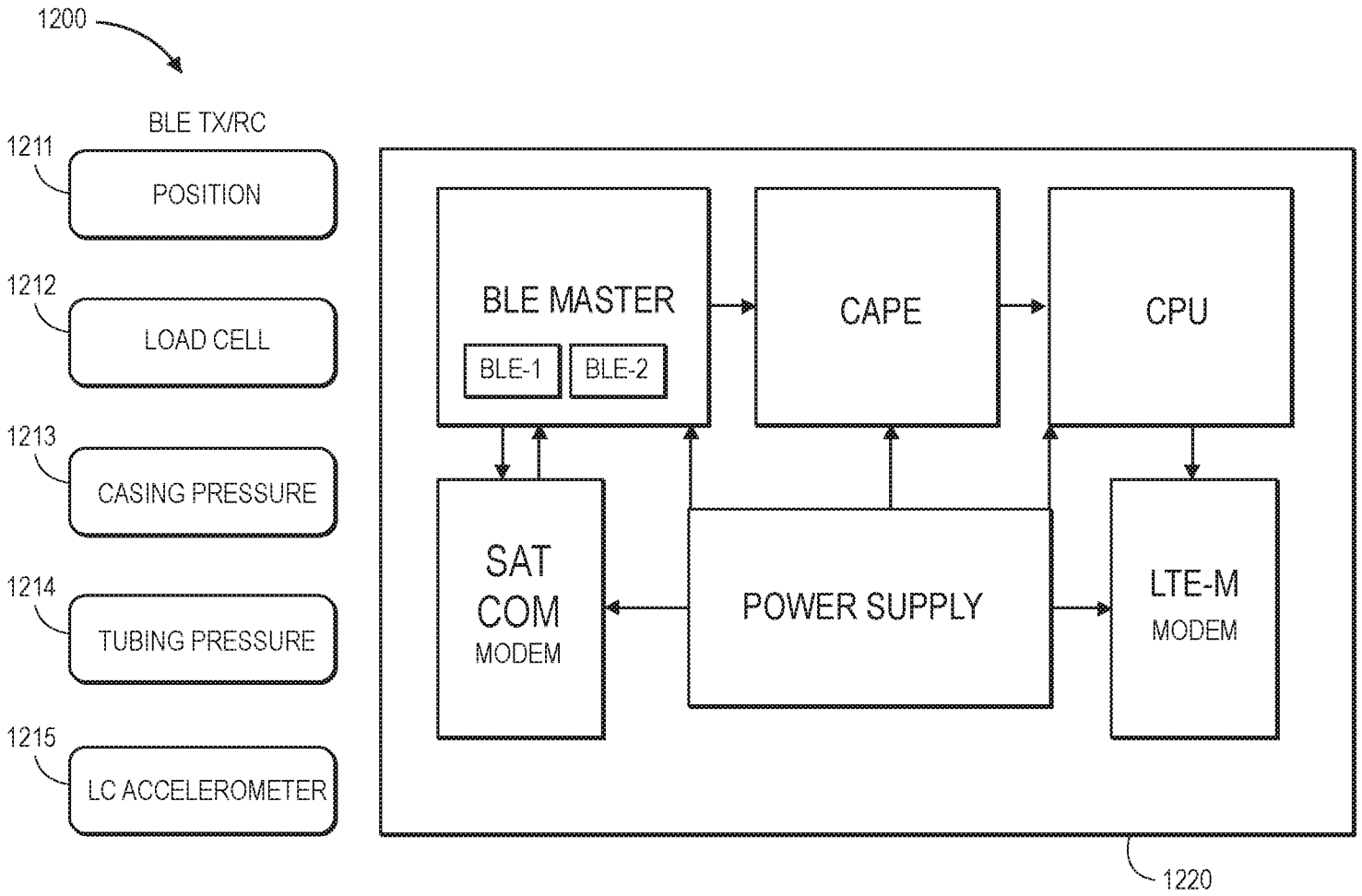
FIG. 12 illustrates a block diagram of another system for monitoring the well, according to an embodiment.

FIG. 12 illustrates a block diagram of a portion of a system 1200 for monitoring the well 152, according to an embodiment. The system 1200 may include one or more sensors: a position sensor 1211, a load cell 1212, a casing pressure sensor 1213, a tubing pressure sensor 1214, and an accelerometer 1215. The position sensor 1211, the load cell 1212, and the accelerometer 1215 may be coupled to the polished rod 124. The sensors 1211-1215 may be in communication with a computing system 1220.

Figure 13:
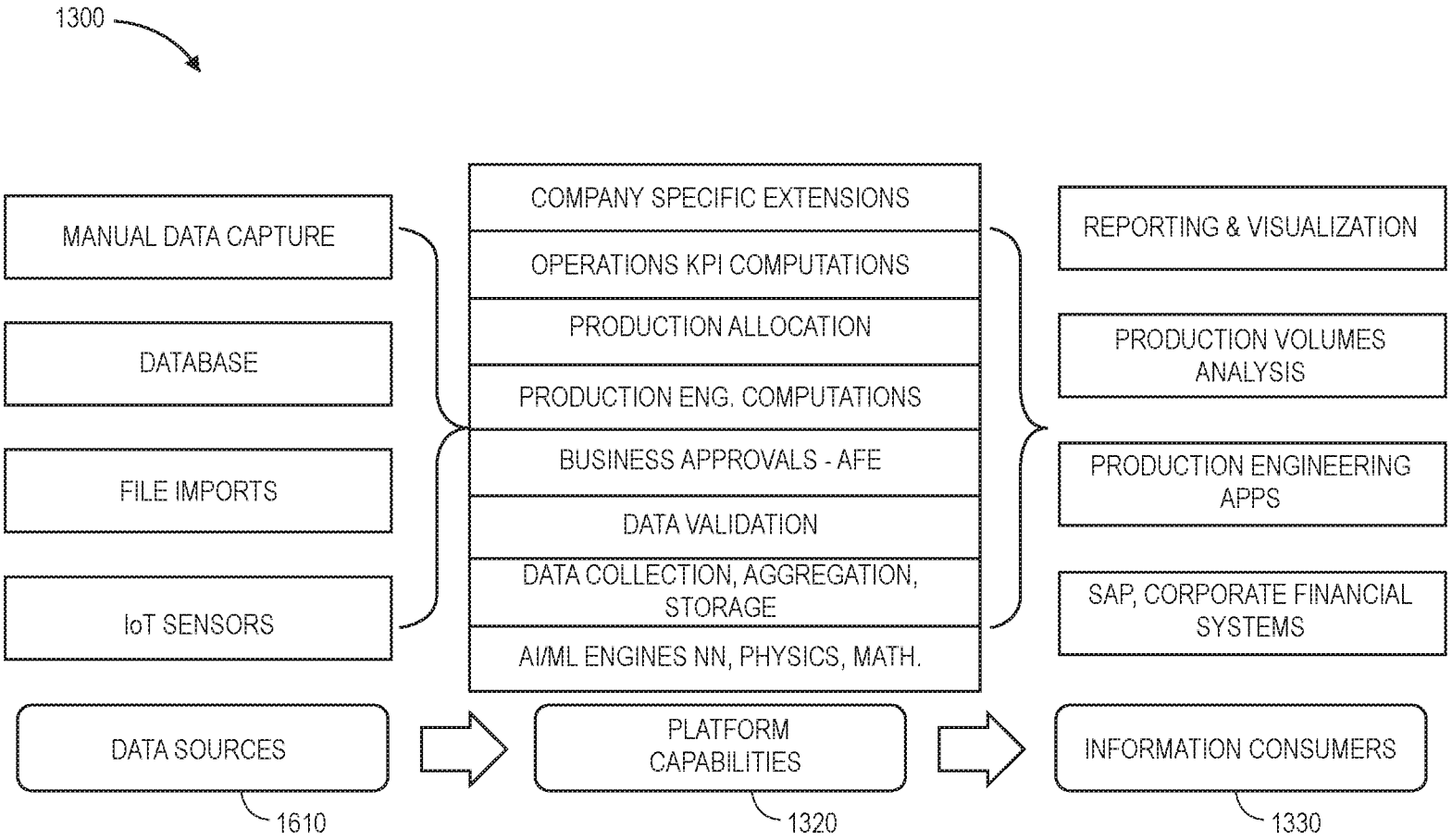
FIG. 13 illustrates a schematic view of a software platform for monitoring the well, according to an embodiment.

FIG. 13 illustrates a schematic view of a software platform 1300 for monitoring the well 152, according to an embodiment. The software platform 1300 may include one or more data sources 1310, one or more platform capabilities 1320, and information consumers 1330.

Figure 14:
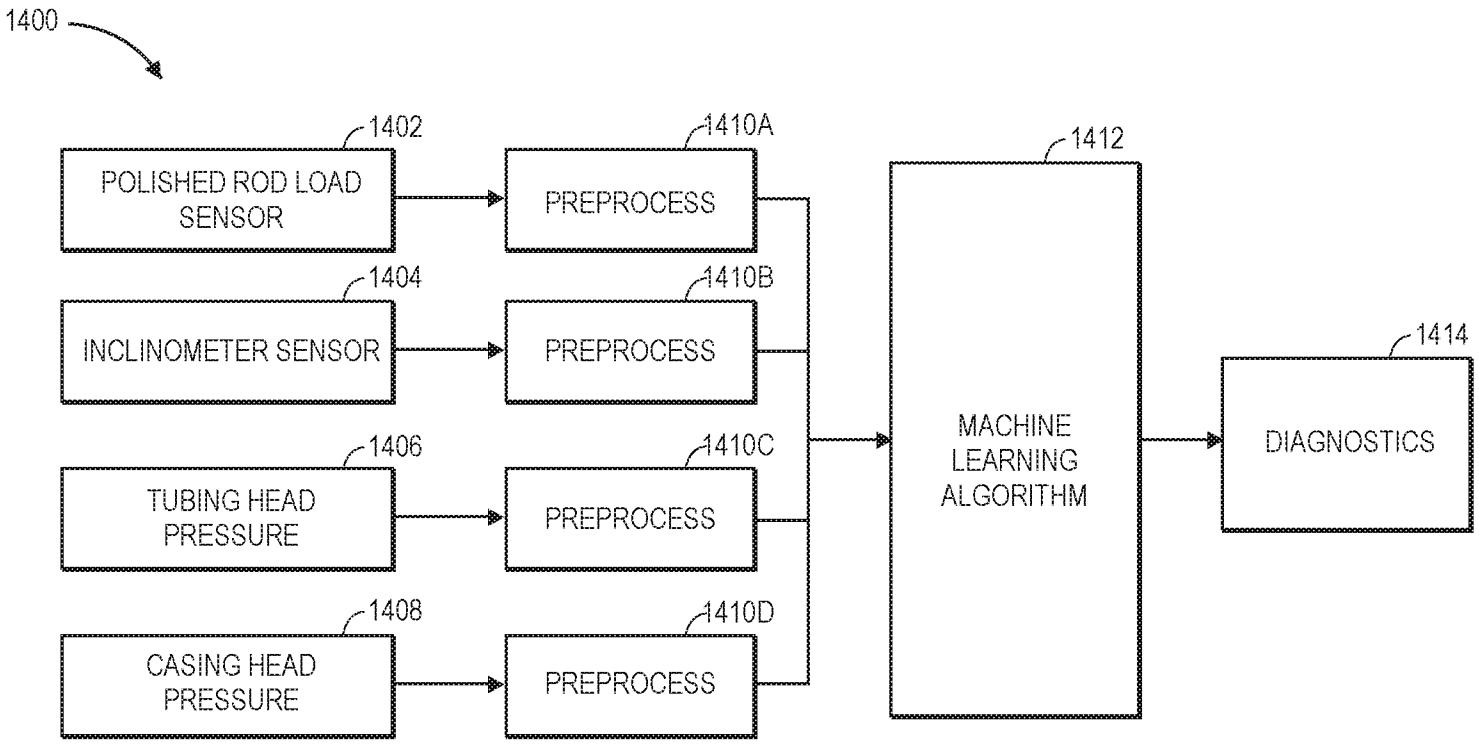
FIG. 14 illustrates a schematic view of a diagnostic process to monitor the well, according to an embodiment.

FIG. 14 illustrates a schematic view of a diagnostic process 1400 to monitor the well 152, according to an embodiment. The signals from a polished rod load sensor 1402, an inclinometer sensor 1404, a tubing head pressure sensor 1406, and a casing head pressure sensor 1408 may be preprocessed, etc., using one or more preprocessors (four are shown: 1410A-1410D). Next, a ML algorithm 1412 may be employed to use the pre-processed data from the sensors 1402-1408 to detect an operating condition and/or diagnose operating issues associated with the beam pump unit 100 and generate a diagnostic code, as at 1414. The ML algorithm 1412 may be trained using a training corpus of surface dynacards associated with various operation conditions, including operating normally and various different possible anomalous operations and their causes. As such, the ML algorithm 1412 may be configured to recognize pump health and diagnose pumping issues using only the surface dynacard, or potentially using the surface dynacard in combination with pressure measurements of the casing head and/or tubing head. This may avoid the drawbacks of the wave equation and the structural information for the beam pump unit 100 and/or the well components, which is often needed to infer the downhole conditions from the surface system's behavior. In other embodiments, the output from the ML algorithm 210 may be combined with the wave equation outputs to form a more robust interpretation of the downhole conditions based at least in part on the surface system's behavior.

Figure 15:
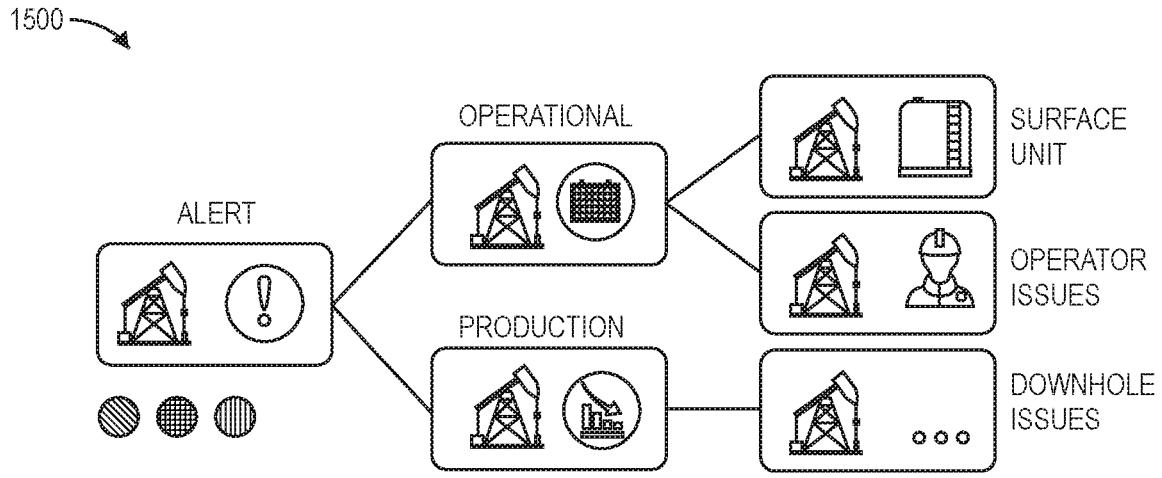
FIG. 15 illustrates a schematic view of process for alerting a user when an issue is detected, according to an embodiment.

FIG. 15 illustrates a schematic view of process 1500 for alerting a user when an issue is detected, according to an embodiment. The alert may indicate whether an issue with the beam pump unit 100 and/or the well 152 is an operational issue or a production issue. If the issue is operational, then the alert may also indicate whether the issue is with the surface unit 102 or the issue is due to the operator. If the issue is a production issue, then the issue may be with the downhole unit 103.

Figure 16:
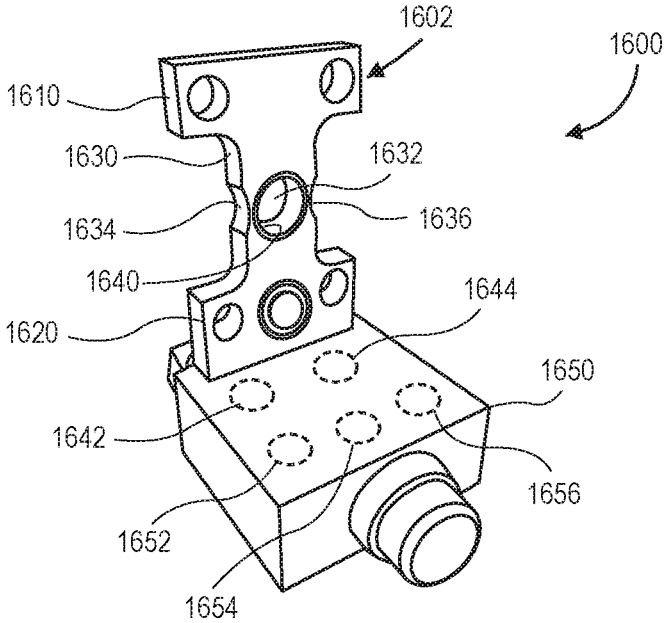
FIG. 16 illustrates a perspective view of a sensor for measuring one or more parameters of the beam pump unit, according to an embodiment.

FIG. 16 illustrates a perspective view of a sensor 1600 for measuring one or more parameters of the beam pump unit 100, according to an embodiment. The sensor 1600 may be configured to be coupled to the polished rod 124 (e.g., between the carrier bar 122 and the stuffing box 125).

The sensor 1600 may include a body 1602 in the shape of an I-beam. The body 1602 may include a first (e.g., upper) clamping mechanism 1610, a second (e.g., lower) clamping mechanism 1620, and a base 1630 positioned between the upper and lower clamping mechanisms 1610, 1620. The upper and lower clamping mechanisms 1610, 1620 may be configured to clamp (i.e., grip) the polished rod 124 at two different points along the polished rod 124 that are axially-offset from one another. The clamping mechanisms 1610, 1620 may be installed on (e.g., coupled to) the polished rod 124 without disassembling the polished rod 124 from the beam pump unit 100 (e.g., without disassembling the polished rod 124 from the carrier bar 122, the stuffing box 125, and/or or the sucker rod 150).

A bore 1632 may be formed at least partially through the base 1630, creating first and second thin segments 1634, 1636 of the base 1630 on opposing sides of the bore 1632. The first thin segment 1634 may be between the bore 1632 and a first side of the base 1630, and the second segment 1636 may be between the bore 1632 and a second side of the base 1630.

A cross-sectional shape of the bore 1632 may be circular. A minimum thickness of the first and/or second thin segment(s) 1634, 1636 may be from about 1 μm to about 1 mm, about 10 μm to about 1 mm, or about 100 μm to about 1 mm. In at least one embodiment, a strain gauge 1640 may be positioned at least partially within the bore 1632. For example, the strain gauge 1640 may be coupled to an inner surface of the base 1630 that defines the bore 1632. In another embodiment, the strain gauge 1640 may include a first portion that is coupled to or embedded at least partially within the first thin segment 1634, and a second portion that is coupled to or embedded at least partially within the second thin segment 1636.

The strain gauge 1640 may measure the relative displacement of the upper and lower clamping mechanisms 1610, 1620 with respect to one another, which may be proportional to the load applied to the polished rod 124. Further, the base 330 may include cutouts, e.g., on either lateral side of the bore 1632, which may serve to reduce a thickness of the thin segments 1634, 1636, thereby decreasing the rigidity of the base 1630. As a result, the sensitivity of the strain gauge 1640 increases.

Referring to the strain gauge 1640 in greater detail, the strain gauge 1640 may be or include a sensor, the resistance of which varies with the applied force/load. The strain gauge 1640 thus converts force, pressure, tension, weight, etc., into a change in electrical resistance that can then be measured and converted into strain. When external forces are applied to a stationary object (e.g., the polished rod 124), stress and strain are the result. Stress is defined as the object's internal resisting forces, and strain is defined as the displacement and deformation that occur. The strain may be or include tensile strain and/or compressive strain, distinguished by a positive or negative sign. Thus, the strain gauge 1640 may be configured to measure expansion and contraction of the polished rod under static or dynamic conditions.

The (e.g., absolute) change of length Δl of the polished rod 124 is the difference between a length l of a section of the polished rod 124 at the time of the measurement and an original length thereof (i.e., the reference length $l_0$). Thus, $\Delta l = l - l_0$. Strain=Δl/l =% elongation. The strain is caused by an external influence or an internal effect. The strain may be caused by a force, a pressure, a moment, a temperature change, a structural change of the material, or the like. If certain conditions are fulfilled, the amount or value of the influencing quantity can be derived from the measured strain value.

In one embodiment, the strain gauge 1640 may be or include a metallic foil-type strain gauge that includes a grid of wire filament (e.g., a resistor) having a thickness less than or equal to about 0.05 mm, about 0.025 mm, or about 0.01 mm. The wire filament may be coupled (e.g., bonded) directly to the strained surface of the base 1630 and/or the polished rod 124 by a thin layer of epoxy resin. When the load is applied to the polished rod 124, the resulting change in surface length of the polished rod 124 and/or the base 1630 is communicated to the resistor, and the corresponding strain is measured in terms of electrical resistance of the wire filament. The resistance may vary linearly with the strain. The wire filament and the adhesive bonding agent work together to transmit the strain. The adhesive bonding agent may also serve as an electrical insulator between the polished rod 124 and the wire filament.

In an embodiment, an enclosure 1650 may be coupled to the body 1602. The enclosure 1650 may define an internal volume that may include the printed circuit board (PCB) 1652, a data storage device 1654, and/or the transceiver 1656. In at least one embodiment, the strain gauge 1640, a gyroscope 1642, and/or an accelerometer 1644 may be coupled to, positioned within, and/or in communication with the PCB 1652, the storage device 1654, the transceiver 1656, or a combination thereof.

Figure 17:
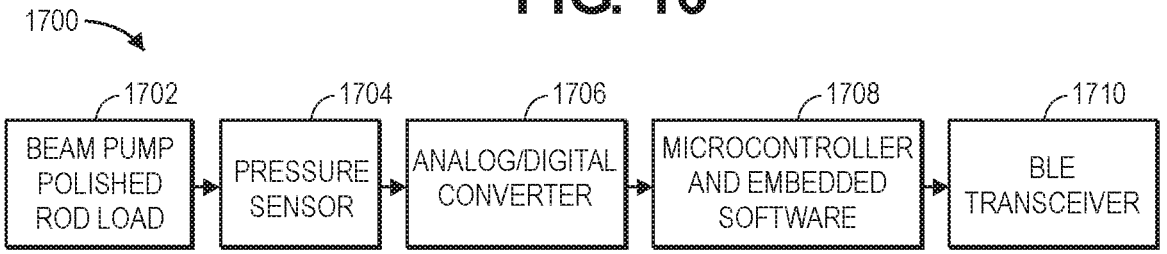
FIG. 17 illustrates a flowchart of a method for monitoring the well (e.g., capturing load data related to the polished rod), according to an embodiment.

FIG. 17 illustrates a flowchart of a method 1700 for monitoring the well 152 (e.g., capturing load data related to the polished rod 124), according to an embodiment. As shown, the beam pump unit 100 is operated at the well site, as at 1702. The strain gauge (also referred to as a load sensor) 1640 is coupled to the polished rod 124 of the beam pump unit 100 and configured to measure the strain and/or load on the polished rod 124, as at 1704. The measurements may be analog. An analog-to-digital converter (ADC) receives the analog measurements and converts the measurements into digital measurements, as at 1706. A microcontroller and embedded software then receives and processes the digital measurements, as at 1708. The signals are then transmitted to an external computing system using a BLUETOOTH® low energy (BLE) transceiver 1656, as at 1710. In at least one embodiment, the ADC, the microcontroller, and the transceiver 1656 may be positioned within the enclosure 1650 that is coupled to the beam pump unit 100.

Figure 18:
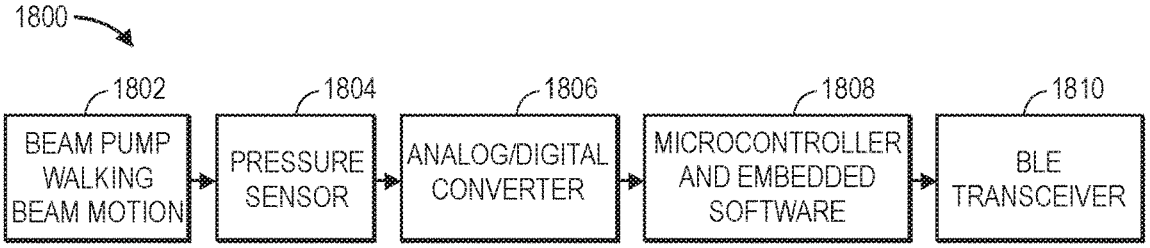
FIG. 18 illustrates a flowchart of another method for monitoring the well (e.g., capturing position data related to the polished rod), according to an embodiment.

FIG. 18 illustrates a flowchart of another method 1800 for monitoring the well 152 (e.g., capturing position data related to the polished rod 124), according to an embodiment. As shown, the beam pump unit 100 is operated at the well site, as at 1802. The inclinometer 1404, gyroscope 1642, and/or accelerometer 1644 may be coupled to a moving component (e.g., the polished rod 124) of the beam pump unit 100 and configured to measure the incline, position, orientation, angular velocity, and/or acceleration of the moving component (e.g., the polished rod 124 as the polished rod 124 cycles up and down), as at 1804. The measurements may be analog. An analog-to-digital converter (ADC) receives the analog measurements and converts the measurements into digital measurements, as at 1806. A microcontroller and embedded software then receives and processes the digital measurements, as at 1808. The signals are then transmitted to an external computing system using a BLUETOOTH® low energy (BLE) transceiver 1656, as at 1810. In at least one embodiment, the ADC, the microcontroller, and the transceiver 1656 may be positioned within the enclosure 1650 that is coupled to the beam pump unit 100.

Figure 19:
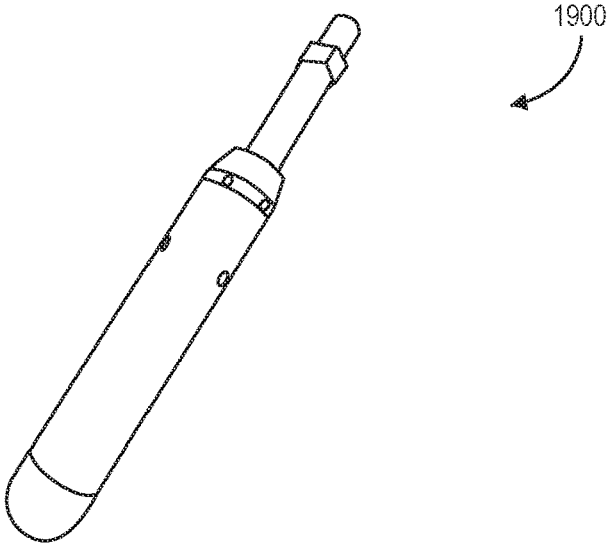
FIG. 19 illustrates a perspective view of a sensor for monitoring pressure in a tubular member, according to an embodiment.

FIG. 19 illustrates a perspective view of a sensor 1900 for monitoring pressure in a tubular member, according to an embodiment. More particularly, the sensor 1900 may be configured to measure the pressure in the production tubing 154 and/or the casing 156 of the well 152.

Figure 20:
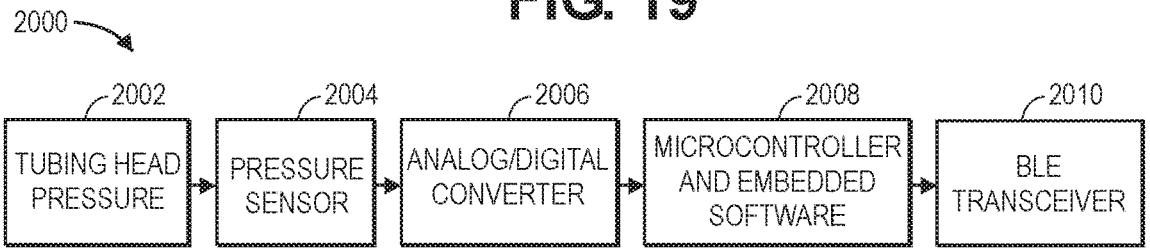
FIG. 20 illustrates a flowchart of a method for monitoring the well, according to an embodiment.

FIG. 20 illustrates a flowchart of a method 2000 for monitoring the well 152, according to an embodiment. As shown, the beam pump unit 100 is operated at the well site, as at 2002. The pressure sensor 1900 may be coupled to and/or in communication with the production tubing 154, as at 2004. The pressure sensor 1900 may be configured to measure the pressure within the production tubing 154. The measurements may be analog. An analog-to-digital converter (ADC) receives the analog measurements and converts the measurements into digital measurements, as at 2006. A microcontroller and embedded software then receives and processes the digital measurements, as at 2008. The signals are then transmitted to an external computing system using a BLUETOOTH® low energy (BLE) transceiver 1656, as at 2010. In at least one embodiment, the ADC, the microcontroller, and the transceiver 1656 may be positioned within the enclosure 1650 that is coupled to the beam pump unit 100.

Figure 21:
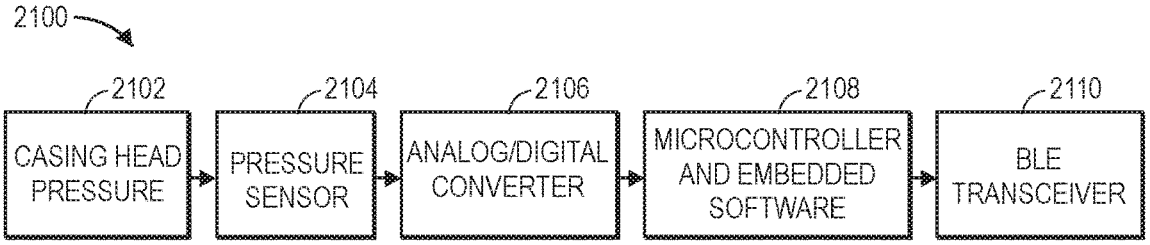
FIG. 21 illustrates a flowchart of a method for monitoring the well, according to an embodiment.

FIG. 21 illustrates a flowchart of a method 2100 for monitoring the well 152, according to an embodiment. As shown, the beam pump unit 100 is operated at the well site, as at 2102. The pressure sensor 1900 may be coupled to and/or in communication with the casing 156, as at 2104. The pressure sensor 1900 may be configured to measure the pressure within the casing 156. The measurements may be analog. An analog-to-digital converter (ADC) receives the analog measurements and converts the measurements into digital measurements, as at 2106. A microcontroller and embedded software then receives and processes the digital measurements, as at 2108. The signals are then transmitted to an external computing system using a BLUETOOTH® low energy (BLE) transceiver 1656, as at 2110. In at least one embodiment, the ADC, the microcontroller, and the transceiver 1656 may be positioned within the enclosure 1650 that is coupled to the beam pump unit 100.

Figure 22:
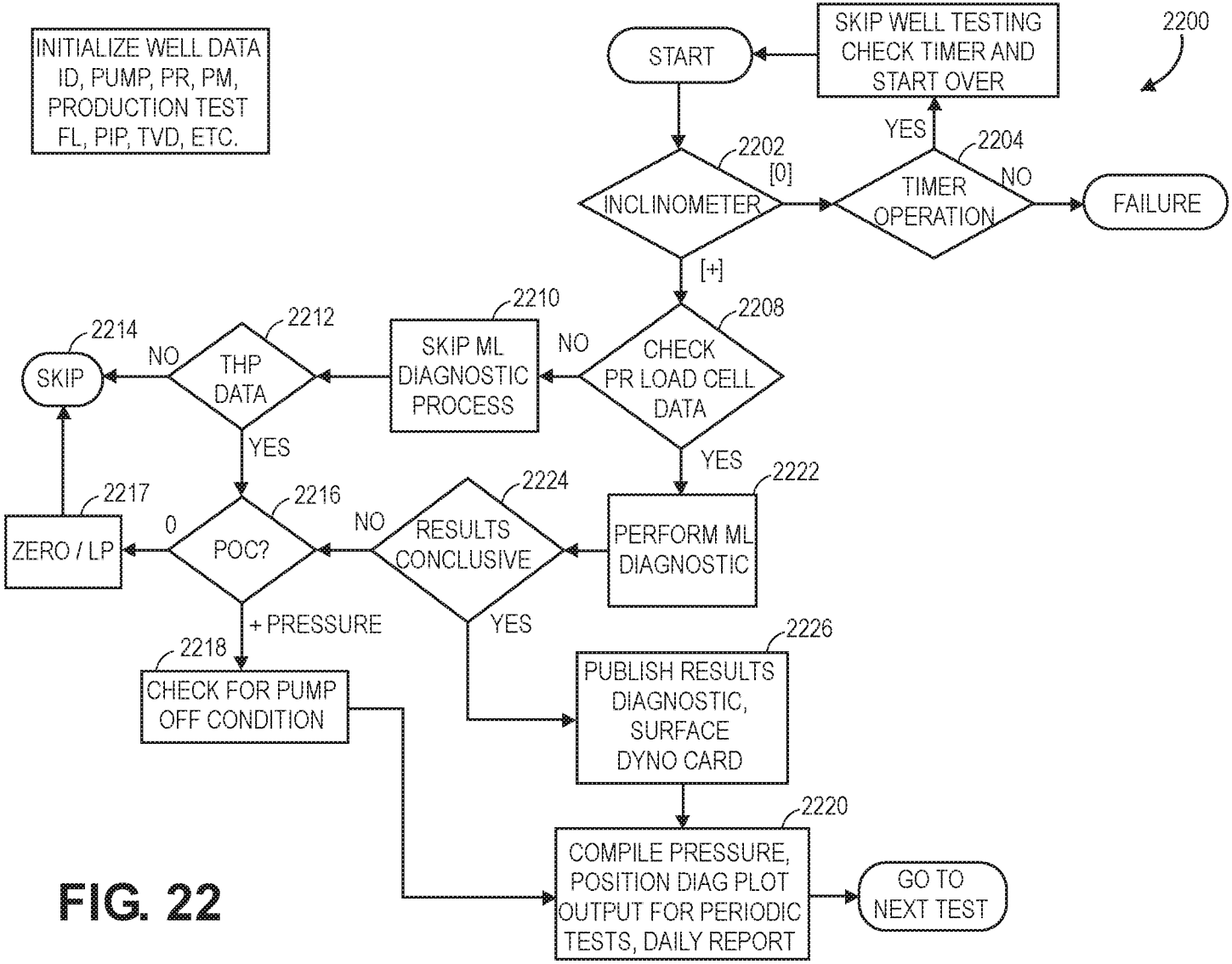
FIG. 22 illustrates a flowchart for cyclic acquisition workflow and diagnostics for monitoring the well, according to an embodiment.

FIG. 22 illustrates a flowchart for cyclic acquisition workflow and diagnostics 2200 for monitoring the well 152, according to an embodiment. The system disclosed herein may differ from conventional systems due to its sensors, processing signals, data, and auto diagnostics at the well site, among other features. In addition, the system may include an I-beam shaped, wireless, polished rod load cell. The system may also or instead include a two-point touch coupled wireless polished rod load cell. The system may also include a sensor for determining displacement of the polished rod. The system may also include an acoustic sensor that may be used to predict failure of at least a portion of the beam pump unit. The system may also include a remote, automated diagnostic capability for determining the sucker rod pump health condition. The system may be non-intrusive to the oil and gas production. The system may provide over-the-air updates and bi-directional communication between the sensors and the processing equipment. The system may also include micro-electrical mechanical systems (MEMS) sensors (e.g., inclinometer, gyroscope, and/or accelerometer).

The system may be used to perform a diagnostic method for determining or detecting the status of the beam pump unit and/or the well using an AI and/or ML algorithm. The statuses may be or include tubing failure, pump failure, load cable failure, improper POC settings, leaking and/or stuck traveling valve, leaking and/or stuck standing valve, excessive pump-off, fluid pound, gas pound, gas interference, flowing well, pump tagging top/bottom, wellbore friction, or the like.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A method, comprising:

receiving acoustic signals from one or more acoustic sensors that are coupled to a beam pump unit, wherein the one or more acoustic sensors comprise:

a first acoustic sensor that is coupled to a polished rod of the beam pump unit;

a second acoustic sensor that is coupled to a gearbox of the beam pump unit; and a third acoustic sensor that is coupled to a prime mover of the beam pump unit;

identifying a frequency of the beam pump unit in the acoustic signals, wherein identifying the frequency of the beam pump unit comprises identifying a frequency of the polished rod, identifying a frequency of the gearbox, and identifying a frequency of the prime mover, wherein the frequency of the polished rod is less than the frequency of the gearbox, and wherein the frequency of the gearbox is less than the frequency of the prime mover; and detecting an outlier in the acoustic signals based at least partially upon the identified frequency of the beam pump unit, wherein the outlier represents an operational issue with the beam pump unit.

2. The method of claim 1, wherein the one or more acoustic sensors are coupled to a walking beam of the beam pump unit, and wherein identifying the frequency of the beam pump unit comprises identifying a frequency of the walking beam.

3. The method of claim 1, wherein the acoustic signals that are received comprise analog acoustic signals, and further comprising:

converting the analog acoustic signals to digital acoustic signals using an analog-to-digital converter; and transmitting the digital acoustic signals to an external computing system using a transceiver, wherein the frequencies are identified in the digital acoustic signals.

4. The method of claim 3, wherein the analog-to-digital converter and the transceiver are positioned within an enclosure, and wherein the enclosure is coupled to the beam pump unit.

5. The method of claim 4, further comprising:

receiving analog strain data from a strain sensor that is coupled to the polished rod of the beam pump unit;

converting the analog strain data to digital strain data using the analog-to-digital converter; and transmitting the digital strain data to the external computing system using the transceiver, wherein the digital acoustic signals and the digital strain data are used to detect the operational issue with the beam pump unit.

6. The method of claim 5, further comprising:

receiving analog gyroscopic data from a gyroscope that is coupled to the polished rod of the beam pump unit;

converting the analog gyroscopic data to digital gyroscopic data using the analog-to-digital converter; and transmitting the digital gyroscopic data to the external computing system using the transceiver, wherein the digital acoustic signals, the digital strain data, and the digital gyroscopic data are used to detect the operational issue with the beam pump unit.

7. A method, comprising:

receiving analog acoustic data from one or more acoustic sensors that are coupled to a beam pump unit, wherein the one or more acoustic sensors comprise:

a first acoustic sensor that is coupled to a polished rod of the beam pump unit;

a second acoustic sensor that is coupled to a gearbox of the beam pump unit; and a third acoustic sensor that is coupled to a prime mover of the beam pump unit, wherein the analog acoustic data comprises a frequency of the polished rod, a frequency of the gearbox, and a frequency of the prime mover, wherein the frequency of the polished rod is less than the frequency of the gearbox, and wherein the frequency of the gearbox is less than the frequency of the prime mover;

receiving analog strain data from a strain gauge that is coupled to the polished rod of the beam pump unit;

receiving analog gyroscopic data from a gyroscope that is coupled to the polished rod;

receiving analog acceleration data from an accelerometer that is coupled to the polished rod;

converting the analog acoustic data, the analog strain data, the analog gyroscopic data, and the analog acceleration data to digital data using one or more analog-to-digital converters; and transmitting the digital data to an external computing system using a transceiver, wherein the digital data is used to detect an operational issue with the beam pump unit.

8. The method of claim 7, wherein the beam pump unit is in communication with a downhole system, and further comprising:

receiving analog pressure data from one or more pressure sensors that are in communication with the downhole system;

converting the analog acoustic data, the analog strain data, the analog gyroscopic data, the analog acceleration data, and the analog pressure data to the digital data using the one or more analog-to-digital converters; and transmitting the digital data to the external computing system using the transceiver.

9. The method of claim 8, wherein the downhole system comprises a production tubing, and wherein the one or more pressure sensors comprise a first pressure sensor that is configured to measure at least a portion of the analog pressure data in the production tubing.

10. The method of claim 9, wherein the downhole system further comprises a casing, and wherein the one or more pressure sensors comprise a second pressure sensor that is configured to measure at least a portion of the analog pressure data in the casing.

11. The method of claim 10, further comprising identifying a location and a cause of the operational issue based at least partially upon the digital data.

12. A system, comprising:

a first acoustic sensor coupled to a polished rod of a beam pump unit and configured to measure first analog acoustic data;

a second acoustic sensor coupled to a gearbox of the beam pump unit and configured to measure second analog acoustic data;

a third acoustic sensor coupled to a prime mover of the beam pump unit and configured to measure third analog acoustic data;

an integrated sensor coupled to the polished rod, wherein the integrated sensor comprises:

a body comprising:

a first clamping mechanism configured to be coupled to the polished rod at a first location along the polished rod;

a second clamping mechanism configured to be coupled the polished rod at second location along the polished rod that is axially-offset from the first location; and a base positioned at least partially between the first and second clamping mechanisms, wherein a bore is defined at least partially through the base; and a strain gauge coupled to the base proximate to the bore, wherein the strain gauge is configured to measure analog strain data as the polished rod cycles up and down;

an enclosure coupled to the beam pump unit;

one or more analog-to-digital converters positioned at least partially within the enclosure and configured to convert the first analog acoustic data, the second analog acoustic data, the third analog acoustic data, and the analog strain data into digital data; and a transceiver positioned at least partially within the enclosure and configured to transmit the digital data to an external computing system.

13. The system of claim 12, wherein the beam pump unit is in communication with a downhole system comprising a production tubing, and wherein the system further comprises a first pressure sensor configured to measure first analog pressure data in the production tubing.

14. The system of claim 13, wherein the downhole system further comprises a casing, and wherein the system further comprises a second pressure sensor configured to measure second analog pressure data in the casing.

15. The system of claim 12, wherein the integrated sensor further comprises:

a gyroscope coupled to the body and configured to measure analog gyroscopic data as the polished rod cycles up and down; and an accelerometer coupled to the body and configured to measure analog acceleration data as the polished rod cycles up and down.

* * * * *